US006318503B1

(12) United States Patent
Hernandez

(10) Patent No.: US 6,318,503 B1
(45) Date of Patent: Nov. 20, 2001

(54) EXTERIOR EMERGENCY ESCAPE SYSTEM FOR USE ON A MULTI-STORIED BUILDING

(76) Inventor: Jose L. Hernandez, 42-25 80th St., Apt. 4-E, Elmhurst, NY (US) 11373

( * ) Notice: Subject to any disclaimer, the term of this patent is extended or adjusted under 35 U.S.C. 154(b) by 0 days.

(21) Appl. No.: 09/401,222

(22) Filed: Sep. 22, 1999

(51) Int. Cl.[7] ..... B66B 9/00; E04G 3/04

(52) U.S. Cl. ..... 187/239; 187/251; 187/263; 187/271; 182/144

(58) Field of Search ..... 187/239, 250, 187/251, 254, 255, 256, 259, 261, 263, 271; 182/142, 143, 144; 254/294, 296, 311, 372

(56) References Cited

U.S. PATENT DOCUMENTS

| | | | | |
|---|---|---|---|---|
| 197,709 | * | 11/1877 | Winkless | 187/239 X |
| 255,379 | * | 3/1882 | Darby | 182/142 X |
| 279,814 | * | 6/1883 | Ripley | 187/239 X |
| 391,854 | * | 10/1888 | Noll et al. | 182/144 X |
| 501,455 | * | 7/1893 | Chetwynd | 182/144 |
| 796,807 | * | 8/1905 | Cavanagh | 254/296 X |
| 882,206 | * | 3/1908 | Murray | 254/396 X |
| 882,677 | * | 3/1908 | Hanssen | 187/259 X |
| 927,946 | * | 7/1909 | Chesebro | 182/143 |
| 3,945,469 | | 3/1976 | Dorgich . | |
| 4,406,351 | | 9/1983 | Littlejohn et al. | 182/47 |
| 5,065,839 | | 11/1991 | Napier | 182/47 |
| 5,127,491 | | 7/1992 | Just-Buddy | 182/142 |
| 5,497,855 | | 3/1996 | Moore | 187/239 |

FOREIGN PATENT DOCUMENTS

| | | | | |
|---|---|---|---|---|
| 19590 | * | 11/1970 | (DE) | 187/239 |
| 379764 | * | 7/1973 | (SU) | 182/142 |

OTHER PUBLICATIONS

"Scaffold hanger system", Louisville Ladder Company's brochure, 4 pages, Dec. 1967.*

* cited by examiner

*Primary Examiner*—Eileen D. Lillis
*Assistant Examiner*—Thuy V. Tran
(74) *Attorney, Agent, or Firm*—Richard L. Miller, P.

(57) ABSTRACT

An exterior emergency escape system for use on a multi-storied building that includes an escape module for holding people escaping from the multi-storied building and for moving along the exterior of the multi-storied building, cables for suspending the escape module from the cornice of the roof, and apparatus for moving the escape module vertically along the exterior of the multi-storied building. In one embodiment, the apparatus is attached to the cornice of the building, and in another embodiment, the apparatus is attached to the escape module.

3 Claims, 2 Drawing Sheets

EXTERIOR EMERGENCY ESCAPE SYSTEM FOR USE ON A MULTI-STORIED BUILDING

BACKGROUND OF THE INVENTION

1. Field of the Invention

The present invention relates to an exterior emergency escape system. More particularly, the present invention relates to an exterior emergency escape system for use on a multi-storied building.

2. Description of the Prior Art

Numerous innovations for emergency escape systems have been provided in the prior art that will be described. Even though these innovations may be suitable for the specific individual purposes to which they address, however, they differ from the present invention.

A FIRST EXAMPLE, U.S. Pat. No. 3,945,469 to Dorcich teaches an escape elevator which is especially useful with tall buildings. The escape elevator slides up and down the outside of the building along a pair of spaced apart tracks. The tracks serve to hold the elevator close to the building as well as to provide guidance for the up and down motion of the elevator. The elevator car or cage extends to either side of the tracks sufficiently to overlap egresses from the building such as balconies. The power winches which operate the elevator are located adjacent the top of the building. A shielded cable is provided which leads from the winches to a point adjacent the ground floor of the building. A remote control box is attachable at the point adjacent the ground floor of the building. Also attachable at the control box is an external power supply to which power to operate the elevator is supplied. The elevator is thus not dependent upon the internal power supply of the building. The remote control device can be operated from a considerable distance from the building whereby the operator, who in most cases will be a fireman, can best observe the fire in the building and direct rescue and fire-fighting efforts.

A SECOND EXAMPLE, U.S. Pat. No. 4,406,351 to Littlejohn et al. teaches an emergency escape system with escape module suspended from a cable or the like along but unattached to the exterior of a multi-storied building, such cable being powered by any suitable mechanism incorporating hoisting and pumping devices such as the ground unit described in co-inventor Cook's U.S. Pat. No. 3,750,686, or the winding drum and water pump of a fire truck or other emergency vehicle, such cable being passed around a pulley supported on the roof of the building, so as to raise the escape module and lower it with encapsulated escapees to a haven. Such escape module is selectively positioned on the side of the building for ingress of escapees and provides such protective and human engineered features as heat shielding of escapees from fire; knotted ropes and handrails for handholds during and after ingress; fluid spray for suppression of fire; water cooling and heat shielding of the floor; total encapsulation of escapees for psychological and safety reasons during rescue; requiring no on-board operator thus avoiding risks to rescue attendants; being of light weight and transportable to permit use on a plurality of multi-storied buildings.

A THIRD EXAMPLE, U.S. Pat. No. 5,065,839 to Napier teaches an escape system for enabling occupants to escape from the upper levels of buildings that includes a vessel suspended from at least two fire-resistant cables spaced apart upon the surface of the vessel, the vessel itself being of fire-resistant material and being substantially air-tight, a bridge affording access for personnel from an adjacent building to the vessel, and lift means for retracting the cables and thus lifting the vessel.

A FOURTH EXAMPLE, U.S. Pat. No. 5,127,491 to Just-Buddy teaches a fire/rescue system that provides a plurality of compartments which are mounted to traverse the vertical side walls of a high-rise building to carry individuals from designated locations, vertically distributed along the side walls of the building, to safety of the base of the building. The compartments are stored prior to use and between uses on the roof of the high-rise building, preferably within a specially-designed garage therefor, thus overcoming the aesthetic deficiencies of external fire escapes. In the event a fire and/or smoke sensing device is activated within the building, one or more of the compartments is ejected from the rooftop storage facility and transverses down the exterior wall(s) of the building. The control system for each compartment is programmed so that the compartment stops briefly at each of certain designated floors too pick up passengers and gradually descends all the way to the ground floor to allow its occupants to exit therefrom. The compartment is then quickly returned to a predesignated point a long the side wall of the building, for example adjacent the if proof, to repeat the descending/passenger pick-up process. The compartments may also be controlled so as to carry one or more firemen from the ground to various floors of the building to facilitate fire-fighting from the exterior.

A FIFTH EXAMPLE, U.S. Pat. No. 5,497,855 to Moore teaches an exterior fire fighting and evacuation system for high rise buildings. A pair of parallelly disposed vertical trollies are attached to the side of the building on opposite sides of a plurality of emergency exists. Decorative panels are provided on either side of the trollies that are aesthetically pleasing and reserve to hide high pressure water and/or foam lines. A chain drive system within each of the pair of trollies mounts a support arm assembly on which a fire proof cab is removably mounted. This cab has front and rear doors and a remote control for operating a motor which drives the chains within both of the trollies simultaneously. This motor can also be operated manually if necessary.

It is apparent that numerous innovations for emergency escape systems have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an exterior emergency escape system for use on a multi-storied building that avoids the disadvantages of the prior art.

ANOTHER OBJECT of the present invention is to provide an exterior emergency escape system for use on a multi-storied building that is simple and inexpensive to manufacture.

STILL ANOTHER OBJECT of the present invention is to provides an exterior emergency escape system for use on a multi-storied building that is simple to use.

BRIEFLY STATED, YET ANOTHER OBJECT of the present invention is to provide an exterior emergency escape system for use on a multi-storied building that includes an escape module for holding people escaping from the multi-storied building and for moving along the exterior of the multi-storied building, cables for suspending the escape module from the cornice of the roof, and apparatus for moving the escape module vertically along the exterior of the multi-storied building. In one embodiment, the apparatus is attached to the cornice of the building, and in another embodiment, the apparatus is attached to the escape module.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

First Embodiment

Figure 6:
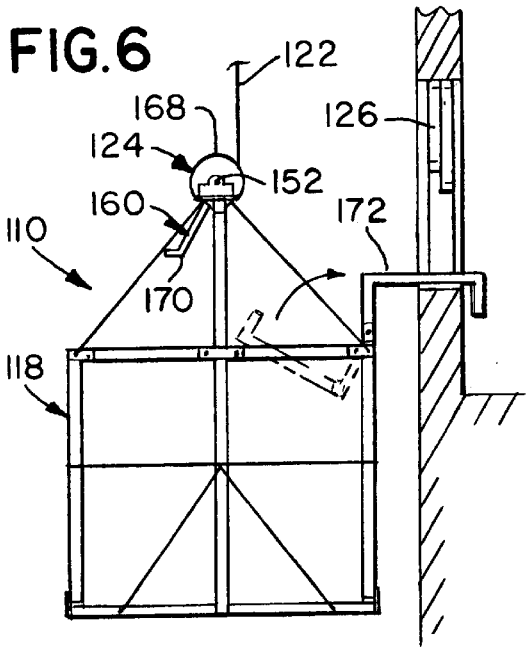
FIG. 6 is a diagrammatic side elevational view taken generally in the direction of arrow 6 in FIG. 5.

10 exterior emergency escape system for use on a multi-storied building
12 multi-storied building
14 roof of multi-storied building 12
15 cornice of roof 14 of multi-storied building 12
16 exterior of multi-storied building 12
18 escape module for holding people escaping from multi-storied building, for moving along exterior 16 of multi-storied building 12, and for aligning with egress 26 through exterior 16 of multi-storied building 12
20 people escaping from multi-storied building 12
22 cables for suspending from cornice 15 of roof 16
24 apparatus for moving escape module vertically along exterior 16 of multi-storied building 12
26 egress through exterior of multi-storied building 12 for allowing people 20 to enter escape module 18 from multi-storied building 12
28 floor of escape module 18 for riding smoothly alone exterior 16 of multi-storied building 12
30 four corners of floor 28 of escape module 18
32 four corner posts of escape module 18
33 terminal ends of four corner posts 32 of escape module 18
34 rails of escape module 18
36 intermediate posts of escape module 18 for preventing people 20 from falling out of escape module 18
38 pair of gable trusses of escape module 18
40 base of each gable truss of pair of gable trusses 38 of escape module 18
42 ends of base 40 of each gable truss of pair of gable trusses 38 of escape module 18
44 pair of equal legs of each gable truss of pair of gable trusses 38 of escape module 18
46 apex of each gable truss of pair of gable trusses 38 of escape module 18
48 pair of support brackets of apparatus 24 for extending outwardly from exterior 16 of cornice 15, above and straddling egress 26 in multi-storied building 12
50 free outermost corner of each support bracket of pair of bracket supports 48 of apparatus 24
52 bearing on free outermost corner 50 of each support bracket of pair of bracket supports 48 of apparatus 24
54 axle of apparatus 24
56 one end of axle 54 of apparatus 24
58 pair of spools of apparatus 24
60 chain and pulley of apparatus 24
62 sheave of chain and pulley 60 of apparatus 24
64 center pin of chain and pulley 60 of apparatus 24
66 drive gear of chain and pulley 60 of apparatus 24
68 driven gear of chain and pulley 60 of apparatus 24
70 endless chain of chain and pulley 60 of apparatus 24 for use by people 20

Second Embodiment

110 exterior emergency escape system for use on a multi-storied building of the present invention
122 cables
124 apparatus
146 pair of hooks of apparatus 124 for hooking over cornice 15 of multi-storied building 12
152 pair of bearings of apparatus 124
154 axle of apparatus 124
158 pair of spools of apparatus 124
160 crank set of apparatus 124
162 bearing block of crank set 160 of apparatus 124
164 center pin of crank set 160 of apparatus 124
166 drive gear of crank set 160 of apparatus 124
168 driven gear of crank set 160 of apparatus 124
170 pair of crank arms of crank set 160 of apparatus 124 for rotating by people 20 escaping from multi-storied building

DETAILED DESCRIPTION OF THE PREFERRED EMBODIMENT

Figure 1:
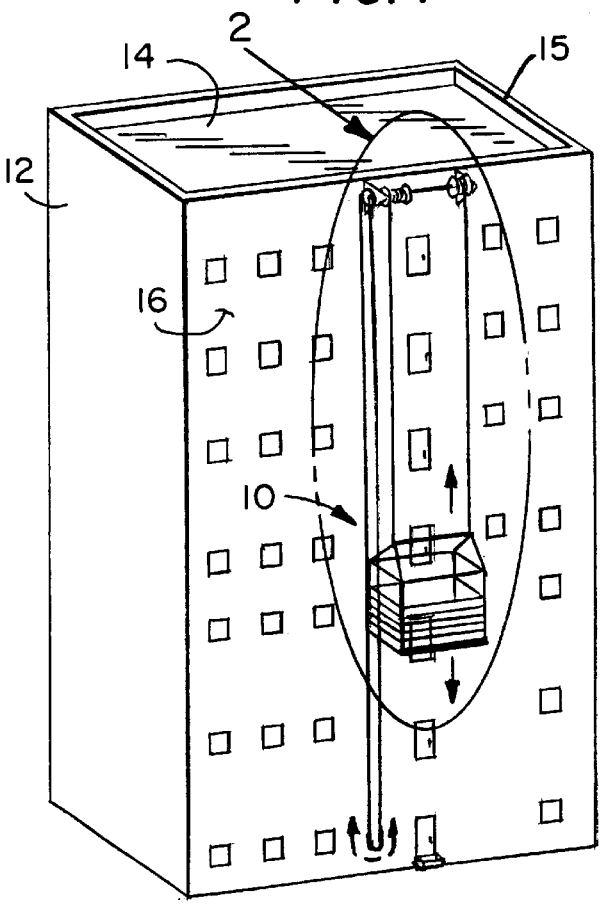
FIG. 1 is diagrammatic perspective view of a first embodiment of the present invention in use.

Referring now to the figures, in which like numerals indicate like parts, and particularly to FIG. 1, a first embodiment of the exterior emergency escape system for use on a multi-storied building of the present invention is shown generally at 10 for use on a multi-storied building 12 having an exterior 16 and a roof 14 with a cornice 15.

Figure 2:
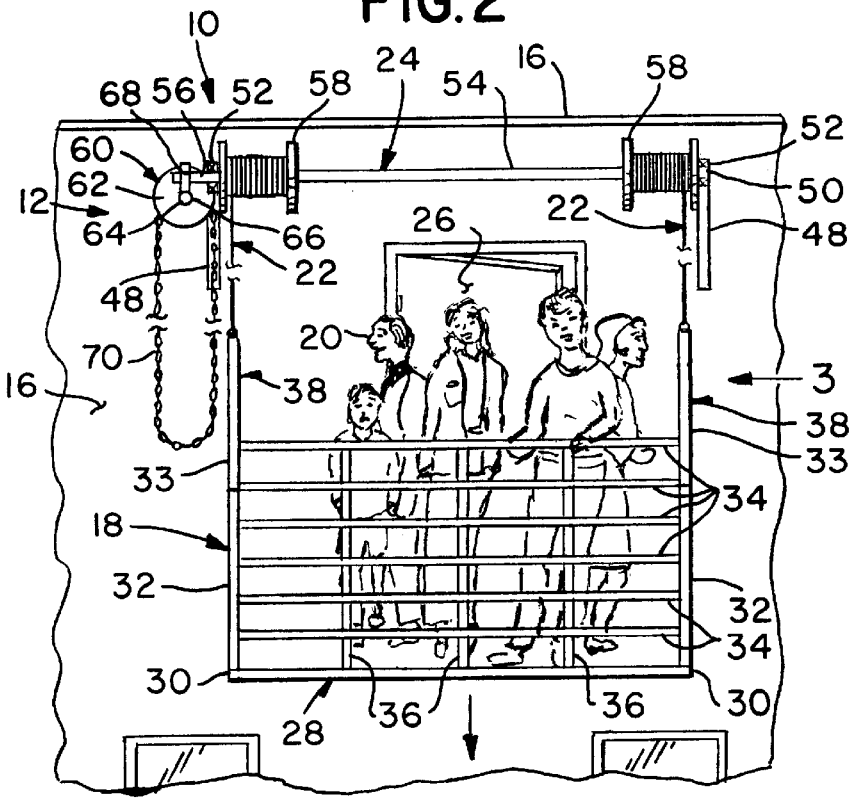
FIG. 2 is an enlarged diagrammatic front elevational view of the area generally enclosed by the dotted curve identified by arrow 2 in FIG. 1 of the first embodiment of the present invention.
Figure 3:
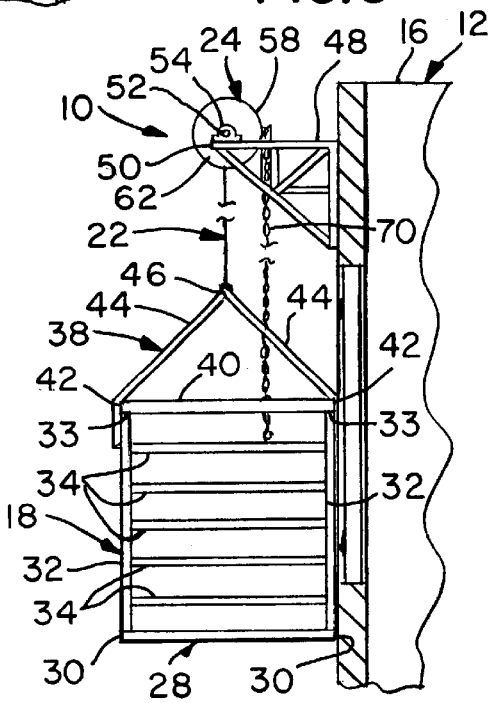
FIG. 3 is a diagrammatic side elevational view taken generally in the direction of arrow 3 in FIG. 2.

The configuration of the exterior emergency escape system for use on a multi-storied building 10 can best be seen in FIGS. 2 and 3, and as such, will be discussed with reference thereto.

The exterior emergency escape system for use on a multi-storied building 10 comprises an escape module 18 for holding people 20 escaping from the multi-storied building 12 and for moving along the exterior 16 of the multi-storied building 12.

The exterior emergency escape system for use on a multi-storied building 10 further comprises cables 22 for suspending the escape module 18 from the cornice 15 of the roof 16.

The exterior emergency escape system for use on a multi-storied building 10 further comprises apparatus 24 for moving the escape module 18 vertically along the exterior 16 of the multi-storied building 12, and which is not attached to the escape module 18.

The escape module 18 is for aligning with an egress 26 through the exterior 16 of the multi-storied building 12, such as a window or a door, for allowing the people 20 to enter the escape module 18 from the multi-storied building 12.

The escape module 18 comprises a floor 28 that is generally rectangular-shaped for riding smoothly alone the exterior 16 of the multi-storied building 12, and has four corners 30.

The escape module 18 further comprises four corner posts 32 that extend vertically upwardly, respectively, from the four corners 30 of the floor 28 thereof to terminal ends 33.

The escape module 18 further comprises rails 34 that are avertically spaced-apart and extend horizontally from one rearmost corner post 32, forwardly to one aligned forwardmost corner post 32, sidewardly to another forwardmost corner post 32, and rearwardly to another rearmost corner post 32.

The escape module 18 further comprises intermediate posts 36 that are horizontally spaced-apart and extend vertically across the rails 34, and together therewith, is for preventing the people 20 from falling out of the escape module 18.

The escape module 18 further comprises a pair of gable trusses 38 that are planar and vertically-oriented. Each gable truss 38 has a base 40 with ends 42, a pair of equal legs 44 that extend inclinely upwardly, respectively, from the ends 42 of the base 40 to an apex 46 where they meet.

The base 40 of one gable truss 38 extends from a terminal end 33 of the one rearmost corner post 32 forwardly to a terminal end 33 of the one aligned forwardmost corner post 32, with the ends 42 of the base 40 of the one gable truss 38 being coincident with the terminal ends 33 of the one rearmost corner post 32 and the one aligned forwardmost corner post 32, while the base 40 of another gable truss 38 extends from a terminal end 33 of the another rearmost corner post 32 forwardly to the another forwardmost corner post 32, with the ends 42 of the base 40 of the another gable truss 38 being coincident with the terminal ends 33 of the another rearmost corner post 32 and the another aligned forwardmost corner post 32.

Each cable 22 extends vertically upwardly from the apex 46 of an associated gable truss 38.

The apparatus 24 comprises a pair of support brackets 48 that are vertically-oriented, parallel to each other, and horizontally spaced-apart for extending outwardly from the exterior 16 of the cornice 15, above and straddling the egress 26 in the multi-storied building 12.

Each support bracket 48 is triangular-shaped and has a free outermost corner 50 with a bearing 52 thereon.

The apparatus 24 further comprises an axle 54 that is horizontally-oriented and rotatably supported through the bearing 52 on each support bracket 48, with one end 56 thereof extending past an associated support bracket 48.

The apparatus 24 further comprises a pair of spools 58 that are disposed on the axle 54 for rotation therewith, with each spool 58 being positioned adjacent to and inward of an associated support bracket 48 and has an associated cable 22 wound therearound.

The apparatus 24 further comprises a chain and pulley 60.

The chain and pulley 60 comprises a sheave 62 that is operatively connected to the axle 54.

The chain and pulley 60 further comprises a center pin 64 that extends through the sheave 62 for rotation therewith.

The chain and pulley 60 further comprises a drive gear 66 that is a worm gear disposed on the center pin 64 for rotation therewith.

The chain and pulley 60 further comprises a driven gear 68 that is positioned on the one end 56 of the axle 54 for rotation therewith and engages with the drive gear 66.

The chain and pulley 60 further comprises an endless chain 70 that is reeved around the sheave 62, and depends alongside the escape module 18 for pulling by the people 20 escaping from the multi-storied building, and when pulled in one direction, causes the sheave 62 to rotate in the one direction, which causes the center pin 64 to rotate in the one direction, which causes the drive gear 66 to rotate in the one direction, which causes the driven gear 68 to rotate in the one direction, which causes the axle 54 to rotate in the one direction, which causes the pair of spools 58 to rotate in the one direction, which causes the cables 22 to unwind from the pair of spools 58 in the one direction, which causes the escape module 18 to be lowered to safety.

Figure 4:
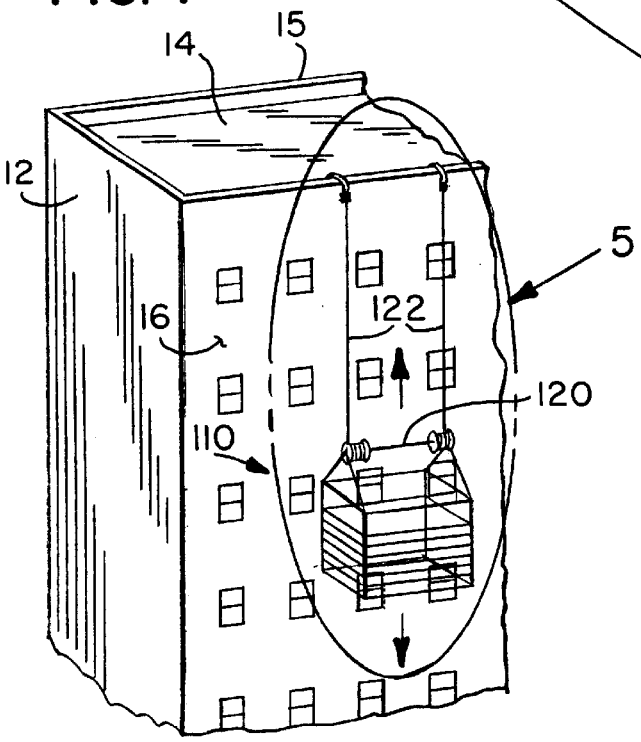
FIG. 4 is diagrammatic perspective view of a second embodiment of the present invention in use.
Figure 5:
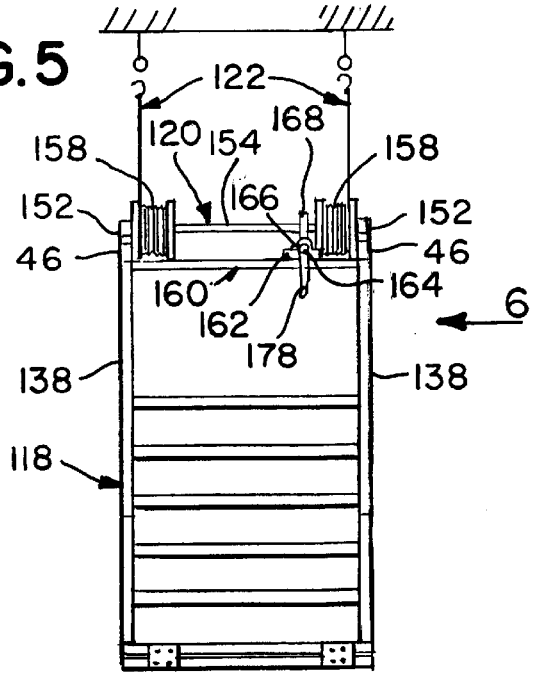
FIG. 5 is an enlarged diagrammatic front elevational view of the area generally enclosed by the dotted curve identified by arrow 5 in FIG. 4 of the second embodiment of the present invention.

The configuration of a second embodiment of the exterior emergency escape system for use on a multi-storied building 110 can best be seen in FIGS. 4 and 5, and as such, will be discussed with reference thereto.

The exterior emergency escape system for use on a multi-storied building 110 is similar to the exterior emergency escape system for use on a multi-storied building 10, except:

1) The apparatus 124 is attached to the escape module 118.
2) A pair of hooks 148 replace the pair of support brackets 48 and, respectively, engage the cables 122 for hooking over the cornice 15 of the multi-storied building 12.
3) The apparatus 124 further comprises a pair of bearings 152, each of which being disposed on the apex 46 of an associated gable truss 138, instead of on the outermost corner 50 of each support bracket 48.
4) The apparatus 124 further comprises an axle 154 that is rotatably supported through the bearing 152 on the apex 46 of each gable truss 138, but without one end thereof extending past an associated bearing 152.
5) The apparatus 124 further comprises a pair of spools 158 that are disposed on the axle 154 for rotation therewith, but with each spool 158 being positioned adjacent to and inward of an associated bearing 152 and has an associated cable 122 wound therearound.
6) The apparatus 124 further comprises a crank set 160 that removes with the escape module 118, and replaces the chain and pulley 60.
7) The crank set 160 comprises a bearing block 162 that is attached to the escape module 118 for movement therewith.
8) The crank set 160 further comprises a center pin 164 that extends through the bearing block 152 for rotation relative thereto.
9) The crank set 160 further comprises a pair of crank arms 170 that extend opposing from ends of the center pin 164 for rotation therewith and for rotating by the people 20 escaping from the multi-storied building 12.
10) The crank set 160 further comprises a drive gear 166 that is a worm gear disposed on the center pin 164 for rotation therewith.
11) The crank set 160 further comprises a driven gear 168 that is positioned on the axle 154 for rotation therewith, adjacent to and inward of one spool 158 and engages with the drive gear 166, and when the pair of crank arms 178 are rotated in one direction, the center pin 164 is caused to rotate in the one direction, which causes the drive gear 166 to rotate in the one direction, which causes the driven gear 168 to rotate in the one direction, which causes the axle 154 to rotate in the one direction, which causes the pair of spools 158 to rotate in the one direction, which causes the cables 122 to unwind from the pair of spools 158 in the one direction, which causes the escape module 118 to be lowered to safety.

12) The escape module 118 further comprises a step 172 that is pivotally mounted thereto and is substantially hooked-shaped for engaging in the egress 26 in the multi-storied building 12 and for providing a walkway for the people 20 escaping into the escape module 118.

It will be understood that each of the elements described above, or two or more together, may also find a useful application in other types of constructions differing from the types described above.

While the invention has been illustrated and described as embodied in an exterior emergency escape system for use on a multi-storied building, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. An exterior emergency escape system for use on a multi-storied building having an exterior and a roof with a cornice, said system comprising:

a) an escape module;

b) cables; and c) apparatus for moving said escape module vertically along the exterior of the multi-storied building;

wherein said escape module is for holding people escaping from the multi-storied building;

wherein said escape module is for moving along the exterior of the multi-storied building;

wherein said cables are for suspending said escape module from the cornice of the roof;

wherein said escape module is for aligning with an egress through the exterior of the multi-storied building for allowing the people to enter said escape module from the multi-storied building;

wherein said escape module comprises a floor;

wherein said floor of said escape module is generally rectangular-shaped;

wherein said floor of said escape module is for riding smoothly along the exterior of the multi-storied building;

wherein said floor of said escape module has four corners;

wherein said escape module comprises four corner posts;

wherein said four corner posts of said escape module extend vertically upwardly, respectively, from said four corners of said floor of said escape module to terminal ends;

wherein said escape module comprises rails;

wherein said rails of said escape module are vertically spaced-apart;

wherein said rails of said escape module extend horizontally from one rearmost corner post of said escape module forwardly to one aligned forwardmost corner post of said escape module, sidewardly to another forwardmost corner post of said escape module, and rearwardly to another rearmost corner post of said escape module;

wherein said escape module comprises intermediate posts;

wherein said intermediate posts of said escape module are horizontally spaced-apart;

wherein said intermediate posts of said escape module extend vertically across said rails of said escape module, and together therewith, is for preventing the people from falling out of said escape module;

wherein said escape module comprises a pair of gable trusses;

wherein said pair of gable trusses of said escape module are planar;

wherein said pair of gable trusses of said escape module are vertically-oriented;

wherein each gable truss of said escape module has a base;

wherein said base of each gable truss of said escape module has ends;

wherein each gable truss of said escape module has a pair of equal legs;

wherein said pair of equal legs of each gable truss of said escape module extend inclinely and upwardly directly from said ends of said base, respectively, to an apex where they meet;

wherein said base of one gable truss extends directly from a terminal end of said one rearmost corner post of said escape module forwardly and directly to a terminal end of said one aligned forwardmost corner post of said escape module;

wherein said ends of said base of said one gable truss of said escape module are coincident with said terminal ends of said one rearmost corner post of said escape module and said one aligned forwardmost corner post of said escape module;

wherein said base of another gable truss extends directly from a terminal end of said another rearmost corner post of said escape module forwardly and directly to a terminal end of said another forwardmost corner post of said escape module;

wherein said ends of said base of said another gable truss of said escape module are coincident with said terminal ends of said another rearmost corner post of said escape module and said another aligned forwardmost corner post of said escape module;

wherein said apparatus comprises a pair of support brackets;

wherein said pair of support brackets of said apparatus are vertically-oriented;

wherein said pair of support brackets of said apparatus are parallel to each other;

wherein said pair of support brackets of said apparatus are horizontally spaced-apart from each other;

wherein said pair of support brackets of said apparatus are for extending outwardly from the exterior of the cornice, above and straddling the egress in the multi-storied building;

wherein each support bracket of said apparatus is triangular-shaped;

wherein each support bracket of said apparatus has a first leg;

wherein said first leg of each support bracket of said apparatus is vertically-oriented;

wherein said first leg of each support bracket of said apparatus has a lowermost end;

wherein said first leg of each support bracket of said apparatus has an uppermost end;

wherein said first leg of each support bracket of said apparatus is for extending vertically along the exterior of the multi-storied building;

wherein each support bracket of said apparatus has a second leg;

wherein said second leg of each support bracket of said apparatus is horizontally-oriented;

wherein said second leg extends horizontally outwardly from said uppermost end of said first leg, to an outermost end;

wherein each support bracket of said apparatus has a hypotenuse;

wherein said hypotenuse depends skewly from said outermost end of said second leg, to said lowermost end of said first leg;

wherein each support bracket of said apparatus has a free outermost corner;

wherein said free outermost corner of each support bracket of said apparatus is formed where said second leg meets said hypothenuse;

wherein said free outermost corner of each support bracket of said apparatus has a bearing thereon;

wherein said bearing is disposed on top of said free outermost corner;

wherein said apparatus comprises an axle;

wherein said axle of said apparatus is horizontally-oriented;

wherein said axle of said apparatus is rotatably supported through said bearing on each support bracket;

wherein one end of said axle of said apparatus extends past an associated support bracket of said apparatus;

wherein said apparatus comprises a pair of spools;

wherein said pair of spools of said apparatus are disposed on said axle for rotation therewith;

wherein each spool of said apparatus is positioned adjacent to, and inward of, an associated support bracket of said apparatus;

wherein each spool of said apparatus has an associated cable of said apparatus wound therearound;

wherein said apparatus comprises a chain and pulley;

wherein said chain and pulley of said apparatus comprise a sheave;

wherein said sheave of said apparatus is operatively connected to said axle of said apparatus;

wherein said chain and pulley of said apparatus comprise a center pin;

wherein said center pin of said apparatus extends through said sheave of said apparatus for rotation therewith;

wherein said chain and pulley of said apparatus comprise a drive gear;

wherein said drive gear of said apparatus is a worm gear;

wherein said worm gear of said apparatus is disposed on said center pin of said apparatus for rotation therewith;

wherein said chain and pulley of said apparatus comprise a driven gear;

wherein said driven gear of said apparatus is positioned on said one end of said axle for rotation therewith; and wherein said driven gear of said apparatus engages with said drive gear of said apparatus.

2. The system as defined in claim 1, wherein each cable extends vertically upwardly from said apex of an associated gable truss.

3. The system as define in claim 1, wherein said chain and pulley further comprises an endless chain that is reeved around said sheave, and depends alongside said escape module for raising and lowering said escape module.

* * * * *